United States Patent [19]

Woodward et al.

[11] Patent Number: 4,936,099

[45] Date of Patent: Jun. 26, 1990

[54] AIR SEPARATION PROCESS FOR THE PRODUCTION OF OXYGEN-RICH AND NITROGEN-RICH PRODUCTS

[75] Inventors: Donald W. Woodward, New Tripoli; Rakesh Agrawal, Allentown, both of Pa.

[73] Assignee: Air Products and Chemicals, Inc., Allentown, Pa.

[21] Appl. No.: 354,173

[22] Filed: May 19, 1989

[51] Int. Cl.[5] ..... F25J 3/02

[52] U.S. Cl. ..... 62/24; 62/31; 62/39

[58] Field of Search ..... 62/11, 23, 24, 31, 32, 62/38, 39

[56] References Cited

U.S. PATENT DOCUMENTS

| | | | |
|---|---|---|---|
| 2,753,698 | 7/1956 | Jakob | 62/123 |
| 4,410,343 | 10/1983 | Fiemer | 62/38 |
| 4,595,405 | 6/1986 | Agrawal et al. | 62/28 |
| 4,617,036 | 10/1986 | Suchdeo et al. | 62/24 |
| 4,662,917 | 5/1987 | Comier, Sr. et al. | 62/39 |
| 4,670,031 | 6/1987 | Erickson | 62/22 |
| 4,704,148 | 11/1987 | Kleinberg | 62/24 |
| 4,705,548 | 11/1987 | Agrawal et al. | 62/28 |
| 4,715,874 | 12/1987 | Erickson | 62/22 |
| 4,769,055 | 9/1988 | Erickson | 62/9 |
| 4,781,739 | 11/1988 | Erickson | 62/22 |
| 4,783,210 | 11/1988 | Ayres et al. | 62/39 |

OTHER PUBLICATIONS

Streich & Dworschak, "Production of Large Quantities of Oxygen by an Improved Two Column Process".

*Primary Examiner*—Ronald C. Capossela
*Attorney, Agent, or Firm*—Willard Jones, II; James C. Simmons; William F. Marsh

[57] ABSTRACT

The present invention is an improvement to a two distillation column, cryogenic air separation process which produces nitrogen-rich and oxygen-rich products. The improvement to the process is condensing at least a portion of the nitrogen overhead from the high pressure column in a reboiler/condenser against a crude liquid oxygen stream and in an intermediate reboiler/condenser located in the low pressure column against internal low pressure column streams. The condensed nitrogen overhead is fed either to the low pressure or high pressure columns as reflux. The vaporized portion of the crude liquid oxygen stream is work expanded to provide some or all of the refrigeration required for the process.

5 Claims, 4 Drawing Sheets

AIR SEPARATION PROCESS FOR THE PRODUCTION OF OXYGEN-RICH AND NITROGEN-RICH PRODUCTS

TECHNICAL FIELD

The present invention relates to a process for the separation of air into its constituent components. More specifically, the present invention relates to a two distillation column, cryogenic air separation process.

BACKGOUND OF THE INVENTION

Numerous processes are know for the separation of air into its constituent parts using a two distillation column system for the production of oxygen, among these are the following:

U.S. Pat. No. 2,753,698 discloses a method for the fractionation of air in which the total air to be fractionated is prefractionated in the pressure column of a double rectifier to produce an impure liquid oxygen bottoms and a gaseous nitrogen overhead. The so produced impure liquid oxygen is expanded to a medium pressure and is completely vaporized in the pressure column by heat exchange with condensing nitrogen. The vaporized oxygen is then slightly warmed, expanded against a load of power production and scrubbed in the low pressure column of the double rectifier by the nitrogen condensed with in the pressure column and entered on top of the low pressure column. The bottom of the low pressure column is reboiled with the nitrogen from the pressure column.

U.S. Pat. No. 4,410,343 discloses a process for the production of low purity oxygen which employs a low pressure and a medium pressure column, wherein the bottoms of the low pressure column are reboiled against condensing air and the resultant air is fed into both the medium pressure and low pressure columns.

U.S. Pat. No. 4,704,148 discloses a process utilizing high and low pressure distillation columns for the separation of air to produce low purity oxygen and waste nitrogen stream, feed air from the cold end of the main heat exchangers is used to reboil the low pressure distillation column and to vaporize the low purity oxygen product. The heat duty for the column reboil and product vaporization is supplied by splitting the air feed into three substreams. One of the substreams is totally condensed and used to provide reflux to both the low pressure and high pressure distillation columns. A second substream is partially condensed with the vapor portion of the partially condensed substream being fed to the bottom of the high pressure distillation column and the liquid portion providing reflux to the low pressure distillation column. The third substream is expanded to recover refrigeration and then introduced into the low pressure distillation column as column feed. Additionally, the high pressure column condenser is used as an intermediate reboiler in the low pressure column.

U.S. Pat. No. 4,769,055 discloses a cryogenic air distillation process for producing medium to high purity oxygen. In the process a minor stream of supply air is additionally compressed, cooled and totally condensed by reboiling the low pressure distillation column. The liquid air is then split into two intermediate reflux streams, one for each the low pressure and high pressure distillation columns.

U.S. Pat. Nos. 4,781,739 and 4,715,874 disclose processes for the production of high purity oxygen wherein the inefficiency of the nitrogen stripping section is reduced. The improvement to these processes is obtained by evaporating kettle liquid with condensing argon rectifier vapor in two sequential stages, to yield streams having respectively more and less oxygen content than the kettle liquid, and then separately feeding these two streams to the nitrogen removal column. The improvement is applicable to both dual and triple pressure processes.

SUMMARY OF THE INVENTION

The present invention is an improvement to a process for the production of low purity gaseous oxygen by the cryogenic distillation of air using two integrally communicating distillation columns at different pressures having a high pressure distillation column and a low pressure distillation column. In the process, feed air is compressed, purified of comtaminants which will freeze at cryogenic temperatures, and cooled; at least a major portion of the compressed, cooled, purified feed air is fed to the high pressure distillation column. Also in the process, low purity liquid oxygen is produced at the bottom of the low pressure distillation column and at least a portion of the liquid oxygen is vaporized by heat exchange with at least a portion of the feed air. The improvement for increasing process energy efficiency comprises providing reflux for both the high pressure and low pressure columns by condensing at least a portion of nitrogen overhead produced at the top of the high pressure column. In the improvement, a first portion of the high pressure column nitrogen overhead is condensed in a reboiler/condenser by heat exchange with a crude liquid oxygen stream, which as a result of the heat exchange is partially vaporized at a pressure greater than the low pressure column pressure and the vaporized portion is removed from the reboiler/condenser as a crude oxygen vapor stream. A second portion is condensed in an intermediate reboiler/condenser located internal to the low pressure column. These condensed portions can be combined and then split to provide reflux to both the low pressure and high pressure columns.

The referenced crude liquid oxygen stream for condensing the first portion of the high pressure column nitrogen overhead is available from one of three locations. The first crude liquid oxygen stream can be removed from the bottom of the high pressure column, subcooled and flashed prior to its introduction to the reboiler/condenser. The second crude liquid oxygen stream can be removed from a lower intermediate location of the high pressure column and flashed prior to its introduction to the reboiler/condenser. Finally, the third liquid oxygen stream can be pumped from a lower intermediate location of the low pressure column and introduced to the reboiler/condenser. Since the crude liquid oxygen stream is partially vaporized at a pressure higher than the low pressure column pressure in the reboiler/condenser, the vapor crude oxygen produced can be warmed and work expanded to provide further refrigeration for the process. This expanded vapor crude oxygen stream would then be fed to the appropriate location of the low pressure column.

DETAILED DESCRIPTION OF THE INVENTION

The present invention is an improvement to a two distillation column, cryogenic air separation process having a high pressure and low pressure column. The improvement, which results in a more energy efficient process, comprises providing reflux for both the high pressure and low pressure columns by condensing at least a portion of the nitrogen overhead produced in the high pressure column. To achieve this end, a first portion of the high pressure column nitrogen overhead is condensed in a reboiler/condenser against partially vaporizing crude liquid oxygen stream, and a second portion is condensed in an intermediate reboiler/condenser located internal to the low pressure column. The condensed portions can be combined and then split to provide the appropriate reflux to both the low pressure and high pressure columns.

The referenced crude liquid oxygen stream for condensing the first portion of the high pressure column nitrogen overhead is available from one of three locations. The first crude liquid oxygen stream can be removed from the bottom of the high pressure column, subcooled and flashed prior to its introduction to the reboiler/condenser. The second crude liquid oxygen stream can be removed from a lower intermediate location of the high pressure column and flashed prior to its introduction to the reboiler/condenser. Finally, the third liquid oxygen stream can be pumped from a lower intermediate location of the low pressure column and introduced to the reboiler/condenser. Since the crude liquid oxygen stream is at a pressure higher than the low pressure column pressure in the reboiler/condenser, the vapor crude oxygen produced can be warmed and work expanded. This expanded vapor crude oxygen stream would then be fed to the appropriate location of the low pressure column.

The present invention can be best understood in reference to four specific embodiments thereof. The first two figures illustrate processes which utilize differing steps for handling the air feed, however, use the preferred process steps of the improvement which is the present invention. The later two figures illustrate processes which utilize variations on the improvement steps. These embodiments are as follow. The four figures use the same numbers for common streams and apparatuses.

Figure 1:
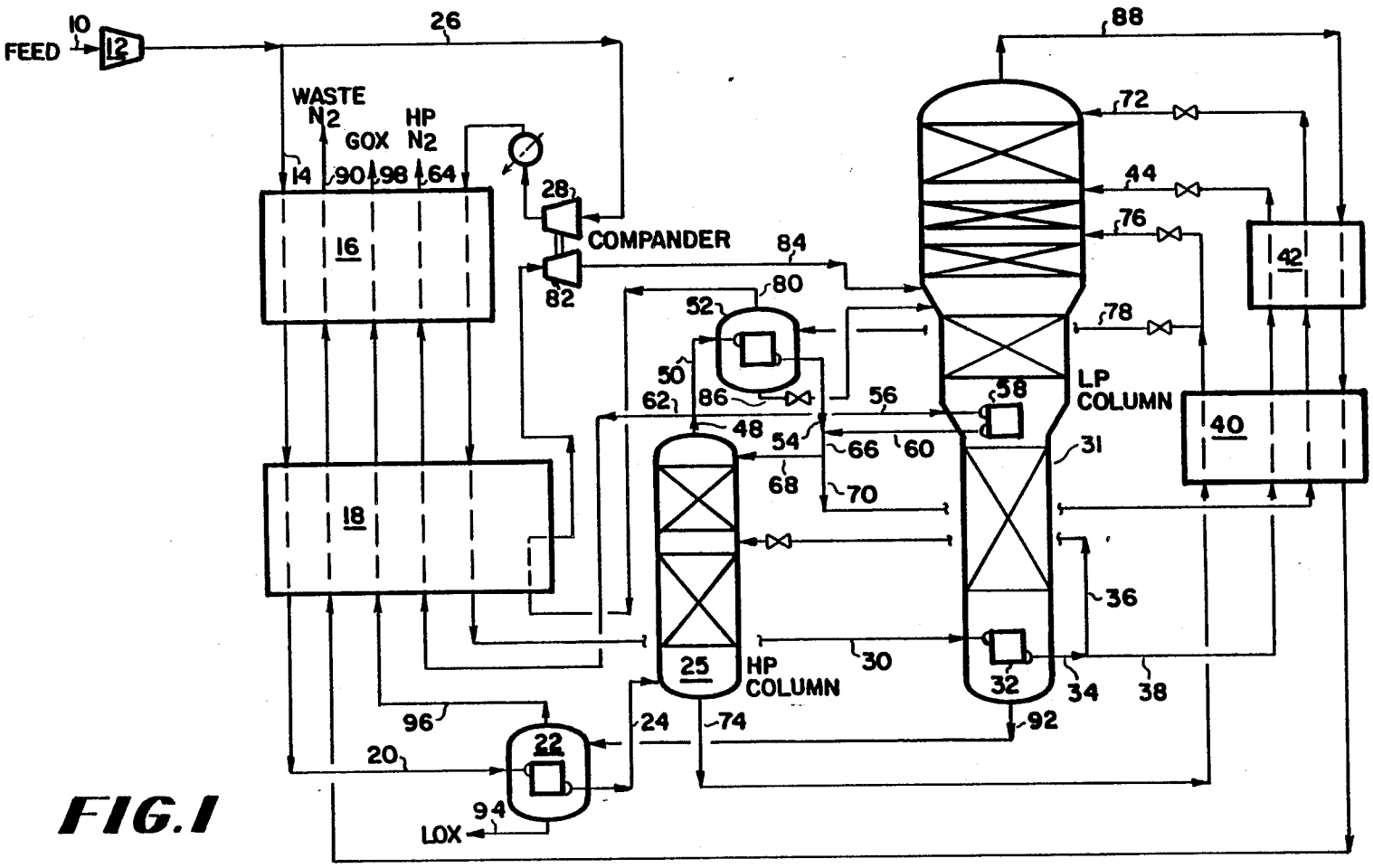
FIG. 1 is a schematic diagram of a first embodiment of the process of the present invention.

With reference to FIG. 1, a preferred embodiment of the present invention is shown. In the process, air is introduced to the process via line 10, compressed in compressor 12, purified of impurities which would freeze at cryogenic temperatures and split into two substreams, in lines 14 and 26, respectively. The first substream in line 14 is then cooled in heat exchangers 16 and 18, partially condensed in reboiler/condenser 22 against boiling liquid oxygen and fed via line 24 to the bottom of high pressure distillation column 25 for rectification. The second substream, in line 26, is further compressed in compressor 28, cooled in heat exchangers 16 and 18, condensed in reboiler/condenser 32 located in the bottom sump of low pressure distillation column 31, and split into two portions, in lines 36 and 38, respectively. The first portion, in line 36, is flashed and fed to an intermediate location of high pressure distillation column 25 as an intermediate reflux. The second portion, in line 38, is subcooled in heat exhangers 40 and 42, flashed, and fed via line 44 to an upper intermediate location of low pressure distillation column 31.

High pressure nitrogen overhead is removed from the top of high pressure distillation column 25 via line 48. This nitrogen overhead, in line 48, is split into three parts, in lines 50, 56 and 62, respectively. The first part, in line 50 is condensed in reboiler/condenser 52 against boiling crude liquid oxygen; the condensed nitrogen is removed from reboiler/condenser 52 via line 54. The second part, in line 56, is condensed in reboiler/condenser 58 located in an intermediate zone of low pressure distillation column 31; the condensed nitrogen is removed from reboiler/condenser 58 via line 60. The third part, in line 62 is warmed in heat exchangers 18 and 16 and removed from the process as high pressure nitrogen product via line 64. The two condensed nitrogen streams, in lines 54 and 60, are combined in line 66 and separated into two reflux streams, lines 68 and 70. The first reflux stream, in line 68, is fed to the top of high pressure distillation column 25. The second reflux stream, in line 70, is subcooled in heat exchangers 40 and 42, flashed and fed via line 72 to the top of low pressure distillation column 31.

Crude liquid oxygen is removed from the bottom of high pressure column 25 via line 74. This crude oxygen stream is subcooled in heat exchanger 40 and then split into two portions, in lines 76 and 78, respectively. The first portion, in line 76, is flashed and fed to an intermediate location of low pressure distillation column 31 as intermediate reflux. The second portion, in line 78, is flashed to a pressure higher than that of the low pressure column pressure and partially vaporized thus providing refrigeration for condensing nitrogen overhead stream 50 in reboiler/condenser 52. The vaporized crude oxygen is removed from reboiler/condenser via line 80, warmed in heat exchanger 18 and work expanded in expander 82. The work produced in work expander 82 is used to drive compressor 28., these two devices are joined in a compander mode. The expanded, cooled crude oxygen is then fed via line 84 to an intermediate location of low pressure distillation column 31. The unvaporized crude liquid oxygen is removed from reboiler/condenser 52 via line 86, flashed and fed to an intermediate location of low pressure distillation column 31.

Liquid oxygen is also removed from the bottom of low pressure distillation column 31 via line 92. This liquid oxygen is fed to reboiler/condenser 22 wherein it is vaporized thus providing the refrigeration to partially condense the first feed air substream in line 20. The vaporized oxygen is removed from reboiler/condenser 22 via line 96, warmed in heat exchangers 18 and 16 to recover refrigeration, and removed from the process as gaseous oxygen product via line 98. If necessary, some liquid can be removed from the process as liquid oxygen product via line 94.

Nitrogen-rich overhead is removed from low pressure distillation column 31 via line 88. This nitrogen overhead is warmed in heat exchangers 42, 40, 18 and 16 to recover refrigeration and then removed as a waste stream from the process via line 90.

Figure 2:
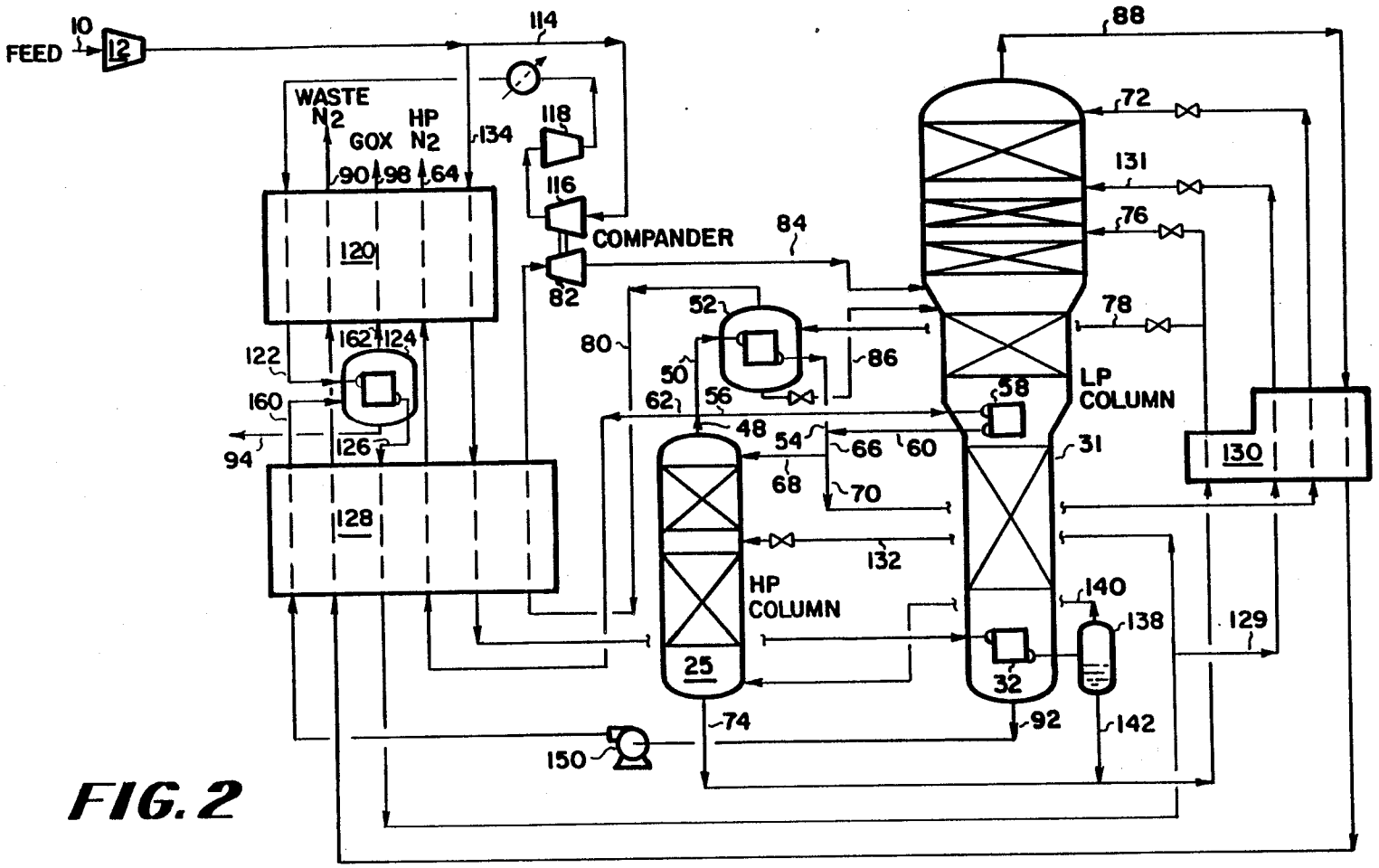
FIG. 2 is a schematic diagram of a second embodiment of the process of the present invention.

With reference to FIG. 2, a second embodiment is illustrated. In the process, air is introduced to the process via line 10, compressed in compressor 12, purified of impurities which would freeze at cryogenic temperatures and split into two substreams, in lines 114 and 134, respectively. The first substream in line 114 is compressed in compressors 116 and 118, then cooled in heat exchanger 120, condensed in reboiler/condenser 124 against boiling liquid oxygen, further cooled in heat exchanger 128, and split into two portions, in lines 129 and 132, respectively. The first portion, in line 132, is flashed and fed to an intermediate location of high pressure distillation column 25 as an intermediate reflux. The second portion, in line 129, is subcooled in heat exhanger 130, flashed, and fed via line 131 to an upper intermediate location of low pressure distillation column 31. The second feed air substream, in line 134, is cooled in heat exchangers 120 and 128, partially condensed in reboiler/condenser 32 located in the bottom sump of low pressure distillation column 31 and phase separated in separator 138. The vapor phase from separator 138 is removed via line 140 and fed to the bottom of high pressure distillation column 25 for rectification. The liquid phase is removed from separator 138 via line 142.

High pressure nitrogen overhead is removed from the top of high pressure distillation column 25 via line 48. This nitrogen overhead, in line 48, is split into three parts, in lines 50, 56 and 62, respectively. The first part, in line 50 is condensed in reboiler/condenser 52 against boiling crude liquid oxygen; the condensed nitrogen is removed from reboiler/condenser 52 via line 54. The second part, in line 56, is condensed in reboiler/condenser 58 located in an intermediate zone of low pressure distillation column 31; the condensed nitrogen is removed from reboiler/condense 58 via line 60. The third part, in line 62 is warmed in heat exchangers 128 and 120 and removed from the process as high pressure nitrogen product via line 64. The two condensed nitrogen streams, in lines 54 and 60, are combined in line 66 and separated into two reflux streams, lines 68 and 70. The first reflux stream, in line 68, is fed to the top of high pressure distillation column 25. The second reflux stream, in line 70, is subcooled in heat exchanger 130, flashed and fed via line 72 to the top of low pressure distillation column 31.

Crude liquid oxygen is removed from the bottom of high pressure column 25 via line 74. This crude oxygen stream combined with the liquid phase in line 142 from separator 138, subcooled in heat exchanger 130 and is then split into two portions, in lines 76 and 78, respectively. The first portion, in line 76, is flashed and fed to an intermediate location of low pressure distillation column 31 as intermediate reflux. The second portion, in line 78, is flashed and partially vaporized thus providing refrigeration for condensing nitrogen overhead stream 50 in reboiler/condenser 52. The vaporized crude oxygen is removed from reboiler/condenser via line 80, warmed in heat exchanger 128 and work expanded in expander 82. The work produced in work expander 82 is used to drive compressor 116., these two devices are joined in a compander mode. The expanded, cooled crude oxygen is then fed via line 84 to an intermediate location of low pressure distillation column 31. The unvaporized crude liquid oxygen is removed from reboiler/condenser 52 via line 86, flashed and fed to an intermediate location of low pressure distillation column 31.

Liquid oxygen is also pumped from the bottom of low pressure distillation column 31 via line 92 using pump 150. This liquid oxygen is fed to reboiler/condenser 124 wherein it is vaporized thus providing the refrigeration to condense the first feed air substream in line 122. The vaporized portion is removed from reboiler/condenser 124 via line 162, warmed in heat exchanger 120 to recover refrigeration, and removed from the process as gaseous oxygen product via line 98. The unvaporized liquid is removed from the process as liquid oxygen product or a purge stream via line 94.

Nitrogen-rich overhead is removed from low pressure distillation column 31 via line 88. This nitrogen overhead is warmed in heat exchangers 130, 128 and 120 to recover refrigeration and then removed as a waste stream from the process via line 90.

As mentioned earlier, generically, the improvement of the present invention is providing reflux for both the high pressure and low pressure columns by condensing at least a portion of the nitrogen overhead produced in the high pressure column by condensing a first portion of the high pressure column nitrogen overhead in a reboiler/condenser against partially vaporizing crude liquid oxygen stream, and a second portion is condensed in an intermediate reboiler/condenser located internal to the low pressure column. The processes of FIGS. 1 and 2 utilize crude oxygen from the bottom of the high pressure distillation column. The processes shown in FIGS. 3 ad 4 show processes using alternate crude oxygen streams.

Figure 3:
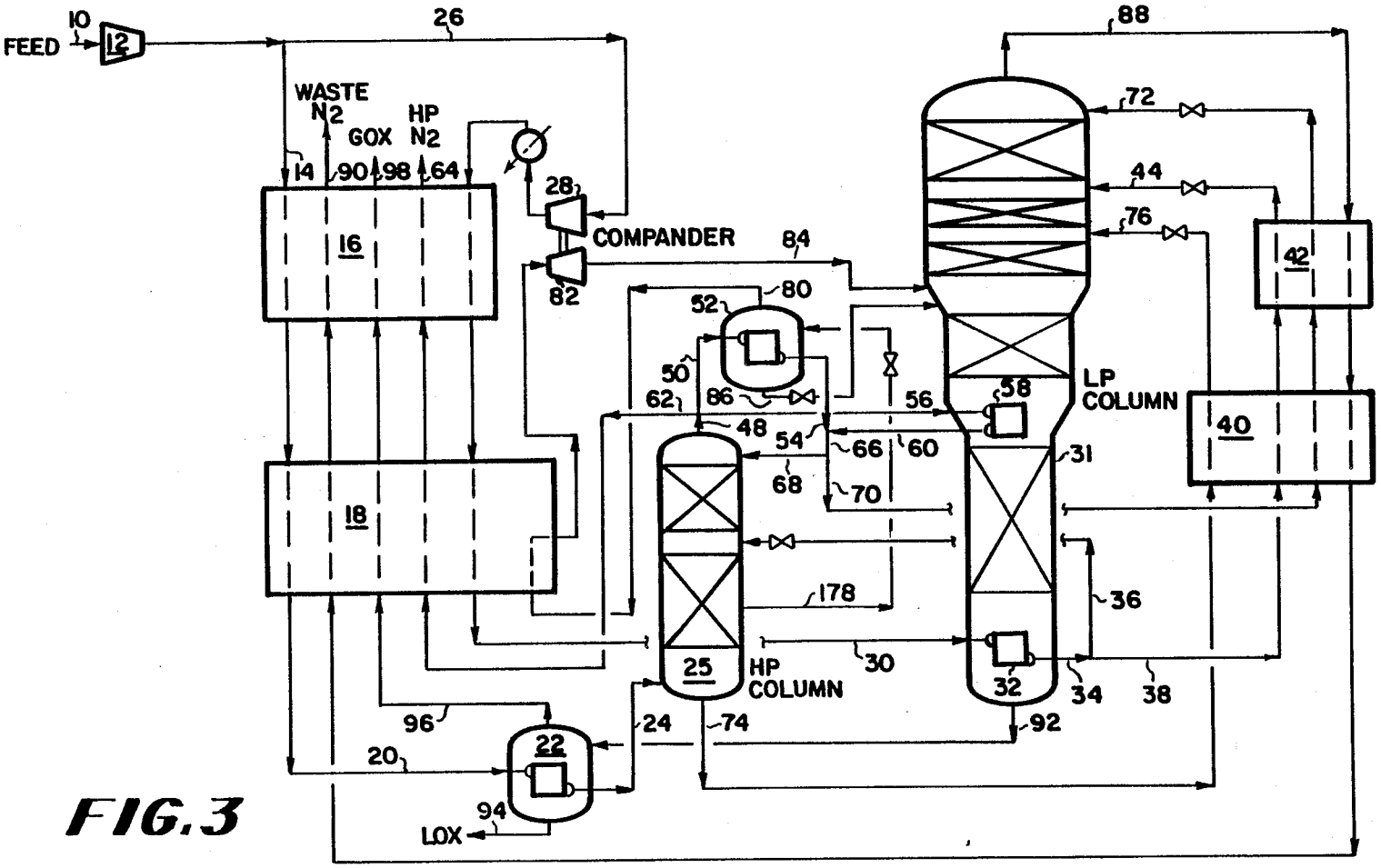
FIG. 3 is a schematic diagram of a third embodiment of the process of the present invention.

FIG. 3 is essentially the process of FIG. 1, except as noted below. With reference to FIG. 3, crude liquid oxygen is removed from the bottom of high pressure column 25 via line 74. This crude oxygen stream is subcooled in heat exchanger 40, flashed and fed to an intermediate location of low pressure distillation column 31 as intermediate reflux. A second crude liquid oxygen stream is removed via line 178 from a lower intermediate location of high pressure distillation column 25. This second crude liquid oxygen stream, in line 178, is flashed and partially vaporized thus providing refrigeration for condensing nitrogen overhead stream 50 in reboiler/condenser 52. The vaporized crude oxygen is removed from reboiler/condenser via line 80, warmed in heat exchanger 18 and work expanded in expander 82.

Figure 4:
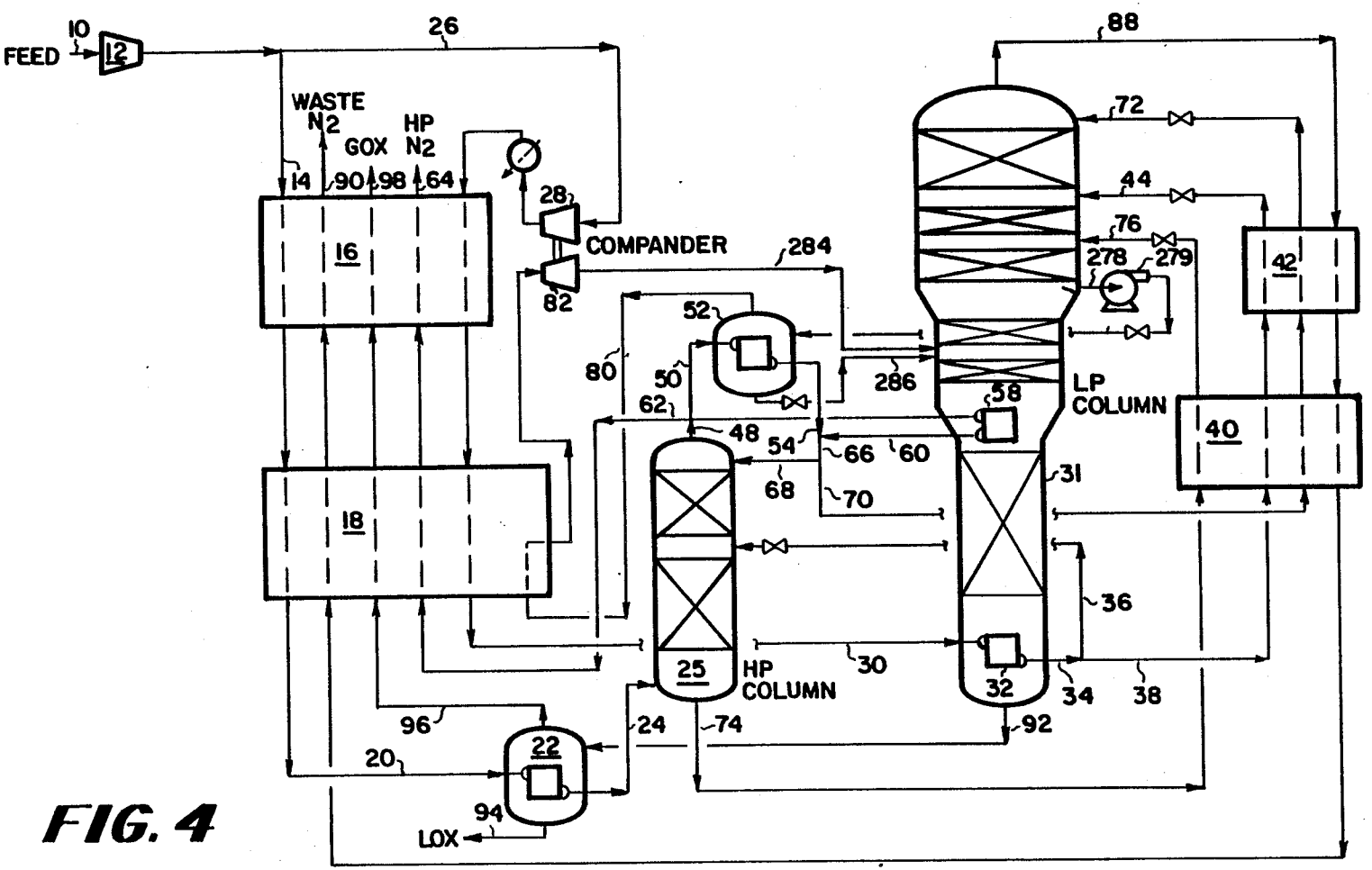
FIG. 4 is a schematic diagram of a fourth embodiment of the process of the present invention.

FIG. 4 is essentially the process of FIG. 1, except as noted below. With reference to FIG. 4, crude liquid oxygen is removed from the bottom of high pressure column 25 via line 74. This crude oxygen stream is subcooled in heat exchanger 40, flashed and fed to an intermediate location of low pressure distillation column 31 as intermediate reflux. A second crude liquid oxygen stream is pumped via line 278 using pump 279 from an intermediate location of low pressure distillation column 31. This second crude liquid oxygen stream, in line 278, is pumped and partially vaporized thus providing refrigeration for condensing nitrogen overhead stream 50 in reboiler/condenser 52. The vaporized crude oxygen is removed from reboiler/condenser via line 80, warmed in heat exchanger 18 and work expanded in expander 82.

To demonstrate the efficacy of the present invention, computer simulations of the processes depicted in FIGS. 1 and 2 were run. These runs also provide a comparison for the selected processes in the prior art. The results of the computer simulations are shown respectively in Tables I and 11. These tables show stream conditions and compositions for selected streams in the processes.

TABLE I

| Stream Number | Temp.: Deg F. | Press.: psia | Total Flow: lb-mol/hr | Component Flows: lb-mol/hr N2 | Ar | O2 |
|---|---|---|---|---|---|---|
| 10 | 85 | 14.7 | 100.0 | 78.1 | 0.9 | 21.0 |
| 14 | 45 | 62.0 | 82.7 | 64.6 | 0.8 | 17.3 |
| 20 | −286 | 59.7 | 82.6 | 64.5 | 0.8 | 17.3 |
| 24 | −289 | 59.5 | 82.6 | 64.5 | 0.8 | 17.3 |
| 26 | 45 | 62.0 | 17.3 | 13.5 | 0.2 | 3.6 |
| 30 | −283 | 68.5 | 17.3 | 13.5 | 0.2 | 3.6 |
| 34 | −289 | 67.7 | 17.3 | 13.5 | 0.2 | 3.6 |
| 36 | −289 | 67.7 | 8.4 | 6.6 | 0.1 | 1.7 |
| 38 | −289 | 67.8 | 8.9 | 6.9 | 0.1 | 1.9 |
| 44 | −312 | 20.9 | 8.9 | 6.9 | 0.1 | 1.9 |
| 50 | −295 | 59.0 | 32.0 | 31.7 | 0.1 | 0.2 |
| 54 | −295 | 59.0 | 32.0 | 31.7 | 0.1 | 0.2 |
| 56 | −295 | 59.0 | 26.2 | 25.9 | 0.1 | 0.2 |
| 60 | −295 | 58.2 | 26.2 | 25.9 | 0.1 | 0.2 |
| 62 | −295 | 59.0 | 1.1 | 1.1 | 0.0 | 0.0 |
| 72 | −315 | 20.0 | 31.2 | 30.9 | 0.1 | 0.2 |
| 78 | −301 | 34.7 | 40.9 | 27.1 | 0.5 | 13.3 |
| 80 | −297 | 34.5 | 29.6 | 21.8 | 0.3 | 7.5 |
| 84 | −296 | 20.6 | 29.6 | 21.8 | 0.3 | 7.5 |
| 88 | −315 | 20.6 | 77.0 | 76.7 | 0.15 | 0.17 |
| 92 | −292 | 21.2 | 21.9 | 0.3 | 0.8 | 20.8 |
| 94 | −290 | 22.7 | 0.1 | 0.0 | 0.0 | 0.1 |
| 96 | −290 | 22.7 | 21.8 | 0.3 | 0.8 | 20.7 |
| 98 | 41 | 20.0 | 21.8 | 0.3 | 0.8 | 20.7 |

TABLE II

| Stream Number | Temp.: Deg F. | Press.: psia | Total Flow: lb-mol/hr | Component Flows: lb-mol/hr N2 | Ar | O2 |
|---|---|---|---|---|---|---|
| 10 | 85 | 14.7 | 100.0 | 78.1 | 0.9 | 21.0 |
| 114 | 45 | 62.6 | 32.0 | 25.0 | 0.3 | 6.7 |
| 122 | −244 | 263.7 | 32.0 | 25.0 | 0.3 | 6.7 |
| 126 | −250 | 263.5 | 32.0 | 25.0 | 0.3 | 6.7 |
| 129 | −289 | 263.5 | 23.6 | 18.5 | 0.2 | 4.9 |
| 131 | −312 | 20.9 | 23.6 | 18.5 | 0.2 | 4.9 |
| 132 | −289 | 263.5 | 8.4 | 6.6 | 0.1 | 1.7 |
| 134 | 45 | 62.5 | 68.0 | 53.2 | 0.6 | 14.2 |
| 48 | −295 | 58.4 | 58.6 | 58.0 | 0.2 | 0.4 |
| 50 | −295 | 58.4 | 31.7 | 31.4 | 0.1 | 0.2 |
| 56 | −295 | 58.4 | 23.8 | 23.6 | 0.1 | 0.2 |
| 62 | −295 | 58.4 | 3.1 | 3.1 | 0.0 | 0.0 |
| 72 | −315 | 20.6 | 28.5 | 28.2 | 0.1 | 0.2 |
| 78 | −303 | 30.6 | 42.3 | 26.5 | 0.6 | 15.2 |
| 80 | −299 | 29.8 | 30.6 | 21.6 | 0.4 | 8.6 |
| 84 | −267 | 21.1 | 30.6 | 21.6 | 0.4 | 8.6 |
| 88 | −315 | 20.6 | 75.1 | 74.7 | 0.2 | 0.2 |
| 90 | 41 | 17.3 | 75.1 | 74.7 | 0.2 | 0.2 |
| 94 | −250 | 119.2 | 0.1 | 0.0 | 0.0 | 0.1 |
| 98 | 41 | 116.5 | 21.7 | 0.3 | 0.8 | 20.6 |

In addition to the simulations of the processes of FIGS. 1 and 2, a comparitive study has been made to several prior art processes. These prior art processes are believed to be the most efficient processes known in the art for the production of low purity gaseous oxygen. The results of this comparative study are shown in Table 111 for the production of 95% purity oxygen.

TABLE III

| Cycle Description | Power: kw-hr/ton $O_2$ | Relative Power |
|---|---|---|
| U.S. Pat. No. 4,704,148 | 205.9 | 1.000 |
| U.S. Pat. No. 4,796,431 | 200.1 | 0.972 |
| U.S. Pat. No. 4,769,055 | 199.5 | 0.969 |
| U.S. Pat. No. 4,410,343 | 214.5 | 1.042 |
| FIG. 1 | 193.4 | 0.939 |
| FIG. 2* | 195.8 | 0.951 |

*oxygen is produced at a higher pressure - an energy credit has been taken for this higher pressure.

In the above comparison, the following assumptions were made:

| | |
|---|---|
| Air Compressor Isothermal Efficiency | 77% |
| $O_2$ Compressor Isothermal Efficiency | 72% |
| $O_2$ Delivery Pressure | 18.6 psia |
| Atmospheric Pressure | 14.7 psia |
| Ambient Temperature | 85° F. |
| Relative Humidity | 60% |

The above comparison shows a 3% specfic power improvement for the process of the present invention over the closest process in the prior art. This improvement is the result of simultaneously condensing high pressure nitrogen from the high pressure column at the same pressure in both an external reboiler/condenser which utilizes a crude liquid oxygen stream as the refrigerant and a reboiler/condenser located internally at an intermediate point in the low pressure distillation column.

The present invention has been described with reference to several specific embodiments thereof. These embodiments should not be viewed as a limitation on the scope of the present invention. Such scope should be ascertained from the following claims.

We claim:

1. In a process for the production of low purity gaseous oxygen by the cryogenic distillation of air using two integrally communicating distillation columns at different pressures having a high pressure distillation column and a low pressure distillation column, wherein feed air is compressed, purified of comtaminants which will freeze at cryogenic temperatures, and cobled., wherein at least a major portion of the compressed, cooled, purified feed air is fed to the high pressure distillation column., wherein a liquid oxygen stream is produced at the bottom of the low pressure distillation column., and wherein, at least a portion of the liquid oxygen stream from the low pressure distillation column is vaporized by heat exchange with at least a portion of the feed air; the improvement for increasing process energy efficiency comprises providing reflux for both the high pressure and low pressure columns by condensing at least a portion of nitrogen overhead produced at the top of the high pressure column, wherein a first portion of the high pressure column nitrogen overhead is condensed in a reboiler/condenser by heat exchange with a crude liquid oxygen stream, which as a result of the heat exchange is partially vaporized at a pressure greater than the low pressure column pressure and the vaporized portion is removed from the reboiler/condenser as a crude oxygen vapor stream, and wherein a second portion is condensed in an intermediate reboiler/condenser located internal to the low pressure column, and providing further refrigeration to the process by work expanding at least a portion of the crude oxygen vapor stream.

2. The process of claim 1 which further comprises combining the first and second condensed portions into a combined liquid nitrogen stream and then splitting the combined liquid nitrogen stream into two reflux streams to provide reflux to the low pressure distillation column and the high pressure distillation column.

3. The process of claim 1 wherein the crude liquid oxygen stream for condensing the first portion of the high pressure column nitrogen overhead is removed from the bottom of the high pressure column, subcooled and flashed prior to heat exchange in the reboiler/condenser with the first portion.

4. The process of claim 1 wherein the crude liquid oxygen stream for condensing the first portion of the high pressure column nitrogen overhead is removed from a lower intermediate location of the high pressure column and flashed prior to heat exchange in the reboiler/condenser with the first portion.

5. The process of claim 1 wherein the crude liquid oxygen stream for condensing the first portion of the high pressure column nitrogen overhead is pumped from a lower intermediate location of the low pressure column and heat exchanged in the reboiler/condenser with the first portion.

* * * * *